US006396029B2

(12) United States Patent
Sugihara et al.

(10) Patent No.: US 6,396,029 B2
(45) Date of Patent: May 28, 2002

(54) HEAT ROLLER

(75) Inventors: Tuyoshi Sugihara, Tatuno; Toru Odagaki, Himeji; Koichi Takegoshi, Himeji; Masatoshi Shimonaka, Himeji, all of (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/736,289

(22) Filed: Dec. 15, 2000

(30) Foreign Application Priority Data

Dec. 16, 1999 (JP) ..... 11-357621

(51) Int. Cl.[7] ..... G03G 15/20; H01K 1/50

(52) U.S. Cl. ..... 219/469; 219/216; 399/331; 362/267; 313/637

(58) Field of Search ..... 219/216, 469; 392/407, 408; 399/329–331; 362/257, 267, 311; 250/504 R, 504 H; 313/637, 567, 578

(56) References Cited

U.S. PATENT DOCUMENTS

| | | | | | |
|---|---|---|---|---|---|
| 3,974,413 | A | * | 8/1976 | Craig | 313/578 |
| 4,591,752 | A | * | 5/1986 | Thouret et al. | 313/579 |
| 4,598,342 | A | * | 7/1986 | English et al. | 362/277 |
| 5,115,119 | A | * | 5/1992 | Adachi et al. | 219/469 |
| 6,163,111 | A | * | 12/2000 | Yasuda et al. | 313/637 |

* cited by examiner

*Primary Examiner*—Joseph Pelham
(74) *Attorney, Agent, or Firm*—Nixon Peabody LLP; David S. Safran

(57) ABSTRACT

A suitable operation temperature can be reached in a short period of time in a heat roller comprising a cylindrical metallic substrate and a heating lamp axially arranged inside said metallic substrate, the heating lamp comprising a bulb filled with a thermally conductive gas and having a filament installed therein, by using a gas whose thermal conductivity is $110\times10^{-4}$ (W/m.K) or less at room temperature.

7 Claims, 3 Drawing Sheets

| Thermal Conductivity (W/m·K) | 56 | 94 | 110 | 130 | 170 | 177 |
|---|---|---|---|---|---|---|
| Start-up Time (sec.) | 16.4 | 16.7 | 17.0 | 18.0 | 20.0 | 23.0 |

| Thermal Conductivity (W/m·K) | 56 | 94 | 110 | 130 | 170 | 177 |
|---|---|---|---|---|---|---|
| Start-up Time (sec.) | 16.4 | 16.7 | 17.0 | 18.0 | 20.0 | 23.0 |

FIG. 3

HEAT ROLLER

BACKGROUND OF THE INVENTION

1. Field of the Invention

This invention relates to a heat roller used, for example, to fix a toner image, in an electrophotographic copier, a laser printer or a fax machine and the like.

2. Description of Related Art

Conventionally, in an electrophotographic copier and the like, a heat roller system is widely used to fix a toner image formed on a recording material by heating. In the heat roller system, the non-fixed toner image is fixed to a recording material by passing the recording material with the non-fixed toner image adhered to it between a heat roller and a press roller located opposite and in contact with the heat roller.

Such a heat roller of the heat roller system as described above has a heating lamp installed inside a cylindrical metallic substrate acting as a roller component, and the metallic substrate is heated up to a predetermined temperature by heat generated from the heating lamp so as to cause the non-fixed toner image to be heated and fixed to the recording material.

In recent years, it has become necessary in the heating and fixing device of the heat roller system that the surface temperature of the heat roller reaches a suitable temperature (at which heating and fixing can be carried out) within a short period of time after turning on a main switch of the device and that the time in which this temperature is reached (hereinafter called "start-up time") is shortened to an order of seconds.

It has been proposed to reduce the start-up time to an order of seconds by making the cylindrical metallic substrate thin although this resulted in the problem that the possibility of reducing the wall thickness is limited, and in the case that the wall thickness is quite thin the strength of the metallic substrate is decreased.

Further, although the distance between the outer surface of the bulb of the heating lamp installed inside the metallic substrate and the inner surface of the metallic substrate was made small, i.e. the inner diameter of the metallic substrate was reduced, the specific design requirements for certain heating devices limit the applicability of this measure to only some kinds of heating devices.

The above-described studies exclusively consider the components of the heat roller other than the heating lamp, and the heating lamp itself acting as a heating source was not studied.

The present inventors have now investigated the heating lamp itself and studied the following items.

The principle of generating heat by a heating lamp consists in that an electric energy is supplied to a filament installed in a heating lamp, to increase the temperature of the filament and to generate heat in the heating lamp by thermal energy being radiated from the high temperature filament.

Just after the main switch of the device is turned on, the thermal energy radiated from the filament is absorbed by the encapsulated gas which is present around the filament and contains halogen and rare gas and thus heats up the gas. Further, the bulb is heated by the enclosed high temperature gas. In other words, it has been found that the absorption phenomenon reduces that part of the thermal energy radiated from the filament which passes through the gas and the bulb to directly reach the metallic substrate and which is not absorbed by the enclosed gas, and this is the cause for delaying the speed with which the metallic substrate increases its temperature.

Further, as a result of the inventor's investigations, it has been found that the extent to which thermal energy radiated from the filament is absorbed by the enclosed gas is substantially influenced by the thermal conductivity of the enclosed gas.

In the prior art heating lamps, argon was mainly utilized as the rare gas and a small amount of halogen was also enclosed. The large amounts of argon in the enclosed gas determined the thermal conductivity.

As a result, since the thermal conductivity of argon is quite high, namely $177\times10^{-4}$ (W/m.K), a certain percentage of the total thermal energy radiated from the filament is absorbed by the argon present around the filament. Consequently, it has been found that the thermal energy radiated from the filament is not efficiently transmitted directly to the metallic substrate and the temperature increasing speed in the metallic substrate cannot be made fast.

SUMMARY OF THE INVENTION

The present invention was made to solve the aforesaid problems. Particularly, it is an object of the present invention to devise a heat roller having a short start-up time while using a heating lamp which is provided with electric energy which is not higher than in the prior art devices and wherein the thermal conductivity of the gas encapsulated in the heating lamp is reduced.

The heating lamp used in the heat roller of the present invention reduces the amount of thermal energy absorbed by the enclosed gas present around the filament as compared with that of the prior art heating lamps even though the total thermal energy radiated from the filament is the same as in the prior art. Almost immediately after the main switch of the device is turned on, a high percentage of the thermal energy radiated from the filament can directly and efficiently be transmitted to the metallic substrate, and the temperature increasing speed of the metallic substrate is fast. That is, the present invention provides a heat roller enabling the surface temperature of the heat roller to reach a suitable operation temperature within a short period of time.

The heat roller described in a first embodiment of the present invention is comprised of a cylindrical metallic substrate and a heating lamp installed axially inside the metallic substrate. The heating lamp has a filament installed in the bulb, gas is enclosed in the bulb and the thermal conductivity of the enclosed gas is $110\times10^{-4}$ (W/m.K) or less at room temperature, for example, 25° C.

Setting the thermal conductivity of the enclosed gas of the heating lamp at $110\times10^{-4}$ (W/m.K) or less enables the heating lamp used in the heat roller of the present invention to reduce the amount of thermal energy which is absorbed by the enclosed gas present around the filament as compared with the prior art heating lamps even if the same electric energy as in the prior art is applied to the filament and also the total thermal energy radiated from the filament is the same as in the prior art. It is thus possible to transmit the thermal energy radiated from the filament at a quite high rate efficiently and directly to the metallic substrate almost immediately after the main switch of the device has been turned on, and there is provided a heat roller in which the temperature increasing speed of the metallic substrate can be increased and the desired surface temperature of the heat roller can be reached within a short period of time.

BRIEF DESCRIPTION OF THE DRAWINGS

FIG. 3 shows experimental data relating to the thermal conductivity of the enclosed gas and the heating time of the metallic substrate of the roller component of the heat roller.

DETAILED DESCRIPTION OF THE INVENTION

Figure 1:
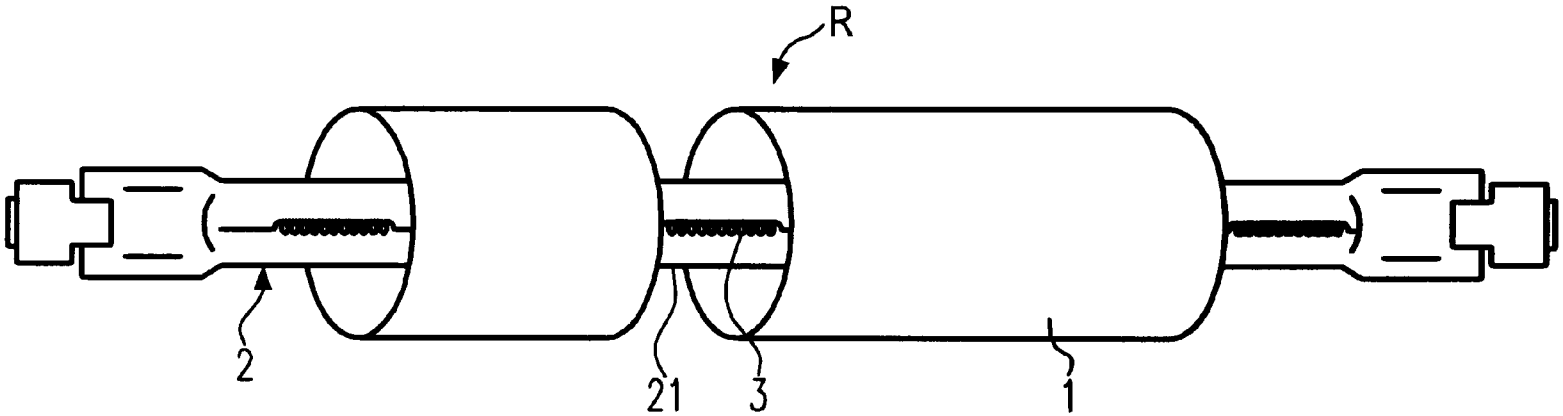
FIG. 1 is an illustrative view showing a heat roller of the present invention.

Referring now to FIG. 1, the heat roller of the present invention will be described.

A heat roller R is comprised of a cylindrical metallic substrate 1 (a hollow cylindrical metal tube) and a heating lamp 2 axially installed inside the metallic substrate 1.

The metallic substrate 1 is made of aluminum and has an inner diameter of 30 mm. The heating lamp 2 has a filament 3 installed within a bulb 21 along the longitudinal axis of the bulb. The encapsulated gas consists of at least 99% krypton and about 1% of bromine providing a halogen incandescent lamp that is lit at 100 V and 800 W.

As described above, the heating lamp 2 is made such that, as the enclosed gas, krypton at 99% or more and halogen at about 1% are enclosed in the bulb, and the thermal conductivity is $94\times10^{-4}$ (W/m.K).

The present inventors then performed an experiment on the temperature increase of heat rollers while changing the thermal conductivity of the enclosed gas. The result of this experiment can be taken from FIG. 2.

Figure 2:
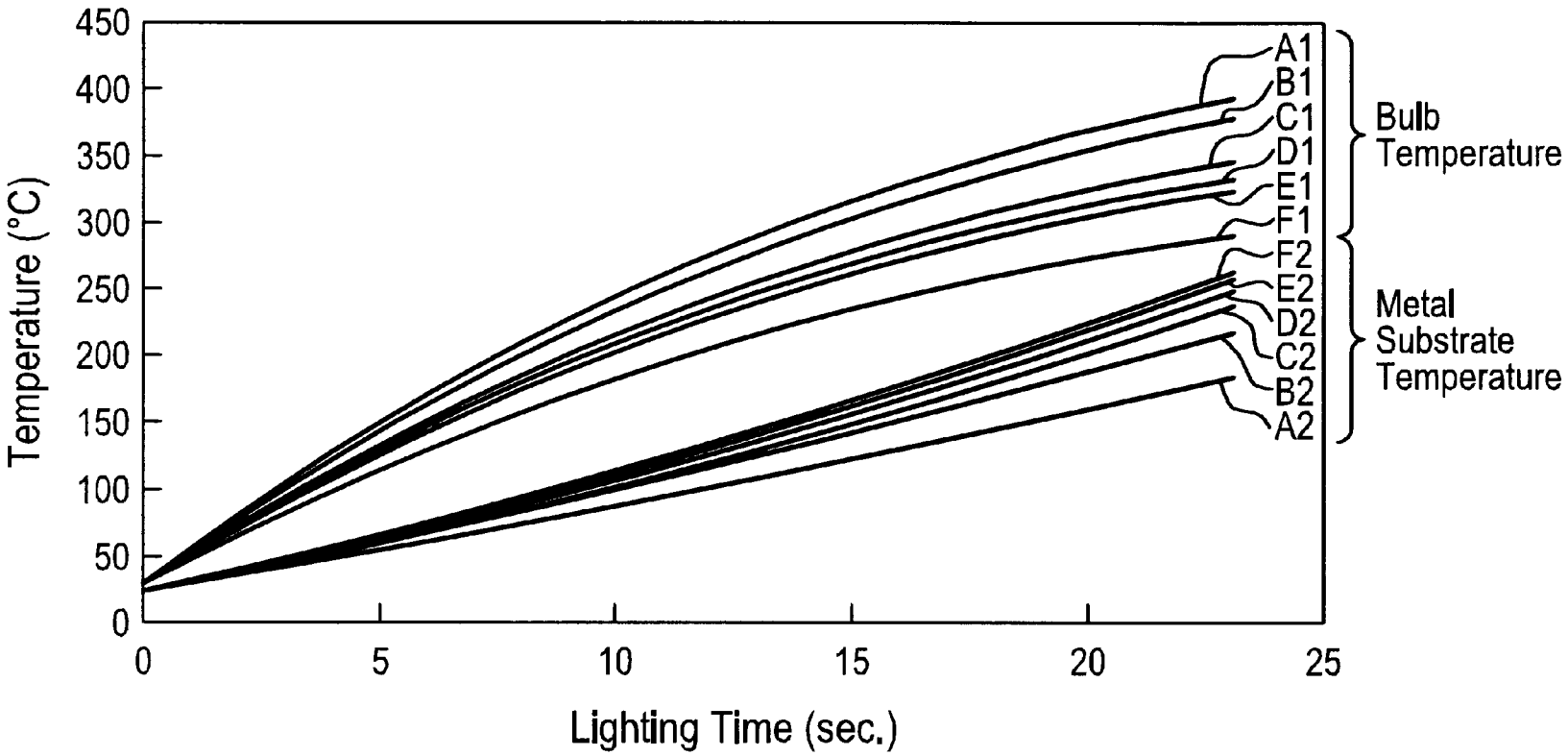
FIG. 2 shows experimental results indicating the start-up characteristics for heat rollers having different thermal conductivity.

FIG. 2 shows a graph in which the abscissa indicates the lighting time (sec.) after the main switch of the device has been turned on and the heating lamp is lit, and the ordinate both the temperature of the bulb of the heating lamp at a specific time of lighting and the temperature of the metallic substrate of the roller section of the heat roller.

The heat roller used in this experiment is similar to the heat roller shown in FIG. 1, and only the enclosed gas of the heating lamp is changed in order to vary the thermal conductivity. The electric energy applied to each of the heating lamps as well as the thermal energy radiated from the filament was always the same for each of the lamps.

As to FIG. 2, it is not possible to perform a direct measurement of the amount of absorption of the thermal energy radiated from the filament by the enclosed gas present around the filament. As a result of thermal energy being absorbed by the enclosed gas the temperature of the enclosed gas was increased leading to an increase in the bulb temperature of the heating lamp. Thus, from the measurement of the bulb temperature the amount of thermal energy radiated from the filament which was absorbed by the enclosed gas can be calculated.

The graph A1 in FIG. 2 shows the bulb temperature in the case that the thermal conductivity of the enclosed gas is $177\times10^{-4}$ (W/m.K). Graph A2 shows the temperature of the metallic substrate of the roller component when the thermal conductivity of the enclosed gas is $177\times10^{-4}$ (W/m.K).

The components of the enclosed gas are argon at 99% and bromine at 1%.

Similarly, the graph B1 indicates the bulb temperature when the thermal conductivity of the enclosed gas is $170\times10^{-4}$ (W/m.K), and the graph B2 indicates the temperature of the metallic substrate of the roller component when the thermal conductivity of the enclosed gas is $170\times10^{-4}$ (W/m.K).

In this case, the components of the enclosed gas are argon at 93%, krypton at 6% and bromine at 1%.

Similarly, the graph C1 indicates the bulb temperature when the thermal conductivity of the enclosed gas is $130\times10^{-4}$ (W/m.K), and the graph C2 indicates the temperature of the metallic substrate of the roller component when the thermal conductivity of the enclosed gas is $130\times10^{-4}$ (W/m.K).

In this case, the components of the enclosed gas are argon at 62%, xenon at 37% and bromine at 1%.

Similarly, the graph D1 gives the bulb temperature when the thermal conductivity of the enclosed gas is $110\times10^{-4}$ (W/m.K), and the graph D2 indicates the temperature of the metallic substrate of the roller component when the thermal conductivity of the enclosed gas is $110\times10^{-4}$ (W/m.K).

The components of the enclosed gas are argon at 45%, xenon at 54% and bromine at 1%.

Similarly, the graph El indicates the bulb temperature when the thermal conductivity of the enclosed gas is $94\times10^{-4}$ (W/m.K), and the graph E2 gives the temperature of the metallic substrate of the roller component when the thermal conductivity of the enclosed gas is $94\times10^{-4}$ (W/m.K).

The components of the enclosed gas in this case are xerion at 99% and bromine at 1%.

Similarly, the graph F1 indicates the bulb temperature when the thermal conductivity of the enclosed gas is $56\times10^{-4}$ (W/m.K), and the graph F2 gives the temperature of the metallic substrate of the roller component when the thermal conductivity of the enclosed gas is $56\times10^{-4}$ (W/m.K)

The components of the enclosed gas in this case are xenon at 99% and bromine at 1%.

As is apparent from the graphs A1, B1, C1, D1, E1 and F1, when the thermal conductivity of the enclosed gas decreases, the bulb temperature at any time after lighting of the heating lamp is kept low. As a result, it is apparent that when the thermal conductivity of the enclosed gas decreases the thermal energy radiated from the filament is hardly absorbed by the enclosed gas present around the filament.

A case has been described in which the same electric energy was applied to all the filaments of the heating lamps.

In this case, the thermal energy radiated from the filaments is the same in all of the lamps.

When the thermal conductivity of the enclosed gas is reduced it becomes possible to reduce the amount of thermal energy absorbed by the enclosed gas present around the filaments in all cases of thermal energy radiated from the filaments.

Accordingly, as apparent from the graphs A2, B2, C2, D2, E2 and F2, it becomes apparent that it is possible to transmit the thermal energy radiated from the filaments at a quite high rate, efficiently and directly to the metallic substrate when the thermal conductivity of the enclosed gas is reduced and to speed up the temperature increase of the metallic substrate.

FIG. 3 shows the result of experiments on the thermal conductivity of the enclosed gas and the heating time of the metallic substrate acting as the roller component of the heat roller.

The start-up time in this case is defined as the time from turning on of the heating lamp, i.e. immediately after the main switch of the device has been turned on, until the time when the temperature of the metallic substrate reaches 180° C.

The heat roller used in this experiment is similar to the heat roller shown in FIG. 1, and only the enclosed gas in the heating lamp and its thermal conductivity are changed.

As is apparent from FIG. 3, in the case of the enclosed gas in which argon at 99% and bromine at 1% are enclosed and the thermal conductivity is $177\times10^{-4}$ (W/m.K), the start-up time is 23 seconds. In addition, in the case of the enclosed gas in which argon by 93%, krypton by 6% and bromine by 1% were enclosed with the thermal conductivity being $170\times10^{-4}$ (W/m.K), the start-up time took as much as 20 seconds and therefore this enclosed gas did not satisfy the requirement of speeding up the start-up time.

In the case of the enclosed gas consisting of argon at 45%, xenon at 54% and bromine at 1% and a thermal conductivity of $110\times10^{-4}$ (W/m.K), the start-up time is as fast as 17 seconds, i.e. shorter than 18 seconds, and so this enclosed gas satisfied the requirement of speeding up the start-up time.

That is, it becomes apparent from FIG. 3 that if the thermal conductivity is $110\times10^{-4}$ (W/m.K) or less it is possible to keep the start-up time at less than 18 seconds so that the heating operation can be sped up.

In addition, the gas in which argon at 62%, xenon at 37% and bromine at 1% are present has a thermal conductivity of $130\times10^{-4}$ (W/m.K) . The gas in which krypton at 99% and bromine at 1% are contained has a thermal conductivity of $94\times10^{-4}$ (W/m.K). The gas containing xenon at 99% and bromine at 1% has a thermal conductivity of $56\times10^{-4}$ (W/m.K).

As described above, the rare gases that can be utilized in the encapsulated gas are krypton, xenon and argon, and the thermal conductivity of the enclosed gas can be changed by mixing these gases or using krypton or xenon as the sole rare gas. For example, it is preferable that the argon content in the encapsulated gas is not higher than about 60% and, most preferable, not higher than about 50%. In this regard, all the percentages given herein are volume percentages based on the total volume of the encapsulated gas.

What is claimed is:

1. A heat roller comprising a cylindrical metallic substrate and a heating lamp axially arranged inside said metallic substrate, said heating lamp comprising a bulb filled with a thermally conductive gas and having a filament installed therein;

wherein the thermal conductivity of said gas is $110\times10^{-4}$ (W/m.K) or less at room temperature.

2. A heat roller according to claim 1, wherein the thermally conductive gas comprises a rare gas.

3. A heat roller according to claim 2, wherein the thermally conductive gas also comprises halogen.

4. A heat roller according to claim 3, wherein the halogen is bromine.

5. A heat roller according to claim 2, wherein the rare gas consists of krypton.

6. A heat roller according to claim 2, wherein the rare gas consists of xenon.

7. A heat roller according to claim 2, wherein the rare gas is a rare gas mixture consisting of argon and at least one of krypton or xenon and wherein at most 45% of the rare gas mixture is argon.

* * * * *